US008341812B2

(12) United States Patent
Kocir

(10) Patent No.: US 8,341,812 B2
(45) Date of Patent: Jan. 1, 2013

(54) CREMATED REMAINS MEMORIAL CONTAINER WITH PICTURE FRAME

(76) Inventor: Marc L. Kocir, Saratoga, CA (US)

( * ) Notice: Subject to any disclaimer, the term of this patent is extended or adjusted under 35 U.S.C. 154(b) by 0 days.

(21) Appl. No.: 13/349,478

(22) Filed: Jan. 12, 2012

(65) Prior Publication Data

US 2012/0180275 A1 Jul. 19, 2012

Related U.S. Application Data

(60) Provisional application No. 61/432,977, filed on Jan. 14, 2011.

(51) Int. Cl.
*A61G 17/00* (2006.01)

(52) U.S. Cl. ..... 27/1; 40/124.5; 40/725

(58) Field of Classification Search ..... 27/1; 40/124.5, 40/721–725, 727, 575–576, 716, 765, 768, 40/770

See application file for complete search history.

(56) References Cited

U.S. PATENT DOCUMENTS

| | | | | |
|---|---|---|---|---|
| 4,199,848 | A * | 4/1980 | Kohnert | 27/1 |
| 5,896,632 | A * | 4/1999 | Sturino | 27/1 |
| 5,950,288 | A * | 9/1999 | Bach Lahor | 27/1 |
| 6,347,439 | B1 * | 2/2002 | Bach Lahor | 27/1 |
| 6,735,831 | B1 * | 5/2004 | Greiwe et al. | 27/1 |
| 7,082,653 | B1 * | 8/2006 | Sueppel | 27/1 |
| 7,117,570 | B1 * | 10/2006 | Borgerding | 27/1 |
| 7,191,499 | B2 * | 3/2007 | Davis et al. | 27/1 |
| 7,373,703 | B1 * | 5/2008 | Grenci | 27/1 |
| 7,562,423 | B2 * | 7/2009 | Pryd-Kakuk | 27/1 |
| 7,793,393 | B2 * | 9/2010 | Roberts | 27/1 |
| 8,046,881 | B2 * | 11/2011 | Johnson et al. | 27/1 |
| 2006/0207075 | A1 * | 9/2006 | Davis | 27/1 |
| 2007/0084743 | A1 * | 4/2007 | Chu | 206/455 |
| 2012/0047699 | A1 * | 3/2012 | Creager | 27/1 |

* cited by examiner

*Primary Examiner* — William L. Miller

(74) *Attorney, Agent, or Firm* — Bever, Hoffman & Harms, LLP; Patrick T. Bever

(57) ABSTRACT

A cremated remains memorial container including a box defining an upper box opening, a picture frame panel attached to the box such that a picture slot is defined between the picture frame panel, and a cover panel that is disposed in the picture slot and has an indented portion extending into the upper box opening. The cover panel is formed from an opaque material, and is slid into the picture slot after the cremated remains are inserted into the box, thereby obscuring the remains. A picture is then inserted in the remaining (residual) space between the cover panel and the picture frame through the picture slot opening. The indented portion of the cover panel engages with the inner edge of the upper box opening, whereby subsequent removal of the cover panel from the picture slot is resisted during removal/replacement of the picture.

10 Claims, 12 Drawing Sheets

CREMATED REMAINS MEMORIAL CONTAINER WITH PICTURE FRAME

RELATED APPLICATIONS

This application claims priority of U.S. Provisional Patent Application 61/432,977, entitled "Cremated Remains Memorial Container With Picture Frame" filed Jan. 14, 2011.

BACKGROUND

Cremated remains memorial containers that have a picture frame for holding a picture of the deceased loved-one (e.g., a person or pet) whose remains (ashes) are contained therein are known in the art.

A problem with such conventional containers is that when a surviving loved one wishes to replace the deceased loved-one's picture, removal of the picture exposes the remains, thereby possibly upsetting the surviving loved one.

Another problem with conventional containers is that different containers are needed to hold pictures having portrait and landscape orientations (i.e., one container type is needed for portrait-oriented pictures in which the up/down direction in the image is aligned with the long edge of the rectangular picture, and another container type is needed for landscape-oriented pictures in which the up/down direction in the image is aligned along the short edge of the rectangular picture).

Another problem with convention containers is that, particularly when used to contain the remains of a pet, the production cost of the container must be minimized.

SUMMARY OF THE INVENTION

The present invention is directed to a cremated remains memorial container that generally includes a box having an upper panel defining an upper box opening that is large enough to pass an object to be stored (e.g., a bag containing the cremated remains of a pet) into the box, a picture frame panel securely attached to the box in an offset position such that a picture slot is defined between the picture frame panel, and a cover panel that is disposed in the picture slot and has an indented portion extending into the upper box opening. The box is made from an opaque material (e.g., wood), and the upper box opening provides the only opening through which cremated remains may be inserted into the box. The picture frame defines an upper opening that is positioned over the upper box opening such that cremated remains must be inserted through the picture frame opening and the upper box opening into the interior of the box. The picture slot is formed such that a picture can be slidably inserted through a front slot opening that is defined along a front edge of the box between the picture frame and the upper box panel. The cover panel is formed from an opaque material (e.g., black or colored plastic), and is slidably inserted into the picture slot through the front slot opening after the cremated remains are inserted into the box (but before inserting the picture), thereby obscuring a surviving loved-one's view of the cremated remains. In accordance with an aspect of the invention, the indented portion of the cover panel is formed such that, when the cover panel is fully inserted into the picture slot, the indented section becomes snap-coupled or otherwise engaged with the inner edge of the upper box opening (i.e., the indented section protrudes through the upper box opening), whereby subsequent removal of the cover panel from the picture slot is significantly resisted by contact between an outside edge of the indented section and the inside edge of the upper box opening. The picture slot is sized such that a picture can be inserted in the remaining (residual) space between the cover panel and the picture frame through the picture slot opening, whereby the picture is held in place by peripheral contact with the portion of the picture frame surrounding the picture frame opening, with the image of the deceased loved-one visible through the picture frame opening. When the surviving loved-one wishes to replace the displayed picture, the picture is manually pressed against the underlying cover panel and pushed toward the picture slot opening, whereby the picture emerges from the picture slot opening. During the replacement process, the front edge of the indented portion presses against an inside edge of the upper box opening to prevent slidable removal of the cover panel during removal of the picture, whereby the opaque cover panel remains in place as the displayed picture is removed and a replacement picture is inserted, thereby preventing undesirable exposure of any cremated remains contained in the interior of the box.

BRIEF DESCRIPTION OF THE DRAWINGS

These and other features, aspects and advantages of the present invention will become better understood with regard to the following description, appended claims, and accompanying drawings, where:

DETAILED DESCRIPTION

The present invention relates to an improved container for a concealed object (e.g., the remains of a deceased pet). The following description is presented to enable one of ordinary skill in the art to make and use the invention as provided in the context of a particular application and its requirements. As used herein, directional terms such as "upper", "upwards", "lower", "downward", "front", "rear" and "side" are intended to provide relative positions for purposes of description, and are not intended to designate an absolute frame of reference. In addition, the phrases "integrally connected" and "integrally molded" is used herein to describe the connective relationship between two portions of a single molded or machined structure, and are distinguished from the terms "connected" or "coupled" (without the modifier "integrally"), which indicates two separate structures that are joined by way of, for example, adhesive, fastener, clip, or movable joint.

Figure 1:
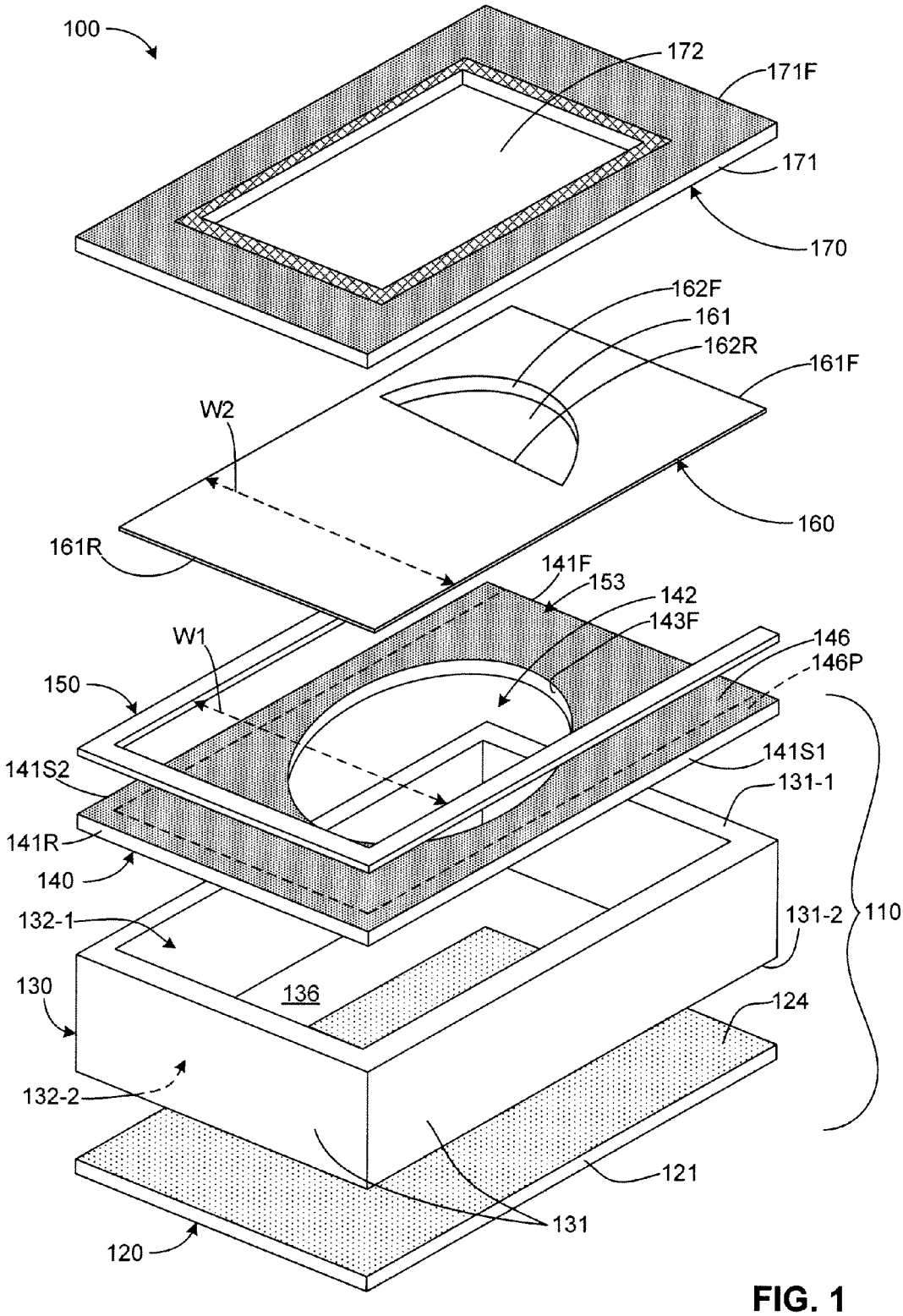
FIG. 1 is an exploded perspective view showing a cremated remains memorial container 100 according to an exemplary embodiment of the present invention.

FIG. 1 is an exploded perspective view showing a cremated remains memorial container 100 according to an exemplary embodiment of the present invention. Container 100 generally includes a box 110, a picture frame support 150, a cover panel 160 and a picture frame panel 170.

Referring to a lower portion of FIG. 1, box 110 generally includes a lower box panel 120, a box frame 130, and an upper box panel 140 that are made from wood and secured together using an appropriate method (e.g., glue or other fastener). Lower box panel 120 is a substantially flat rectangular sheet having a peripheral edge 121 and an upper surface 124. Box frame 130 includes peripheral walls 131 that surround and define a box interior (remains chamber) 136. Upper box panel 140 is also flat rectangular sheet, but defines an upper box opening 142 having a size that is large enough to allow passage of remains (or other objects to be concealed) into interior 136 when box 110 is fully assembled. For purposes of discussion, the narrow side edge disposed at the right portion of FIG. 1 is referred to as the Picture frame support 150 is an open (three-sided) frame structure that mounts onto an upper surface 146 of upper box panel 140 such that frame structure 170 is disposed in peripheral region 146P along the side peripheral edges 147 and rear peripheral edge 144 of upper box panel 140 (i.e., in the region depicted in FIG. 1 between the side and rear edges and the dashed lines shown on upper surface 146). Note that picture frame support 150 is open along front edge 143 of upper box panel 140 in order to form a picture slot opening 153, which is described in additional detail below. In a presently preferred embodiment, picture frame support 150 comprises two-sided tape having a thickness sufficient to provide the picture slot height described below.

Cover panel 160 is formed from an opaque, semi-rigid material (e.g., a sheet of black or colored plastic) using molding or embossing techniques known to those skilled in the art. In accordance with an aspect of the invention, cover panel 160 is substantially planar except for an indented portion 162 that extends out of the cover panel plane (e.g., downward in FIG. 1). Cover panel 160 has a rectangular outer peripheral edge including a width W2 that is sized to fit inside picture frame support 150 with minimal clearance (e.g., width W2 is equal to or slightly smaller than width W1 of picture frame support 150), and a length (e.g., the distance between a rear peripheral edge 161R and a front peripheral edge 161F) that is sized to fit inside front slot opening 153 when container 100 is fully assembled. Indented section 162 includes a rear edge 161R that facilitates assembly in the manner described below, an a front edge 161F that is formed to engage with an inner front edge section 143F of upper box opening 142 in order to prevent slidable removal of cover panel 160 after remains are inserted into box 110. In the disclosed embodiment, front edge 161F is shaped to match the shape of inner front edge section 143F in order to maximize the contact area between these two edges. In other arrangements (not shown), the indented section may have any arbitrary shape (e.g., the indented section may be in the shape of the container manufacturing company's logo).

Picture frame 170 is a substantially flat rectangular structure that is formed from a planar rigid material (e.g., flat plastic), and is preferably adorned in a tasteful manner to provide an aesthetically pleasing frame for the displayed picture. Picture frame 170 is fixedly attached to box 110 by way of picture frame support 150 in a manner that provides picture opening slot 153, which is described in additional detail below. In one embodiment, the peripheral edges 171 of picture frame 170 are substantially aligned with the outer peripheral edge of box 110 after assembly (e.g., front edge 171F is substantially aligned with front edge 141F of front panel 140). Picture frame 170 defines an upper opening 172 that is positioned over upper box opening 142 after assembly.

Figure 2:
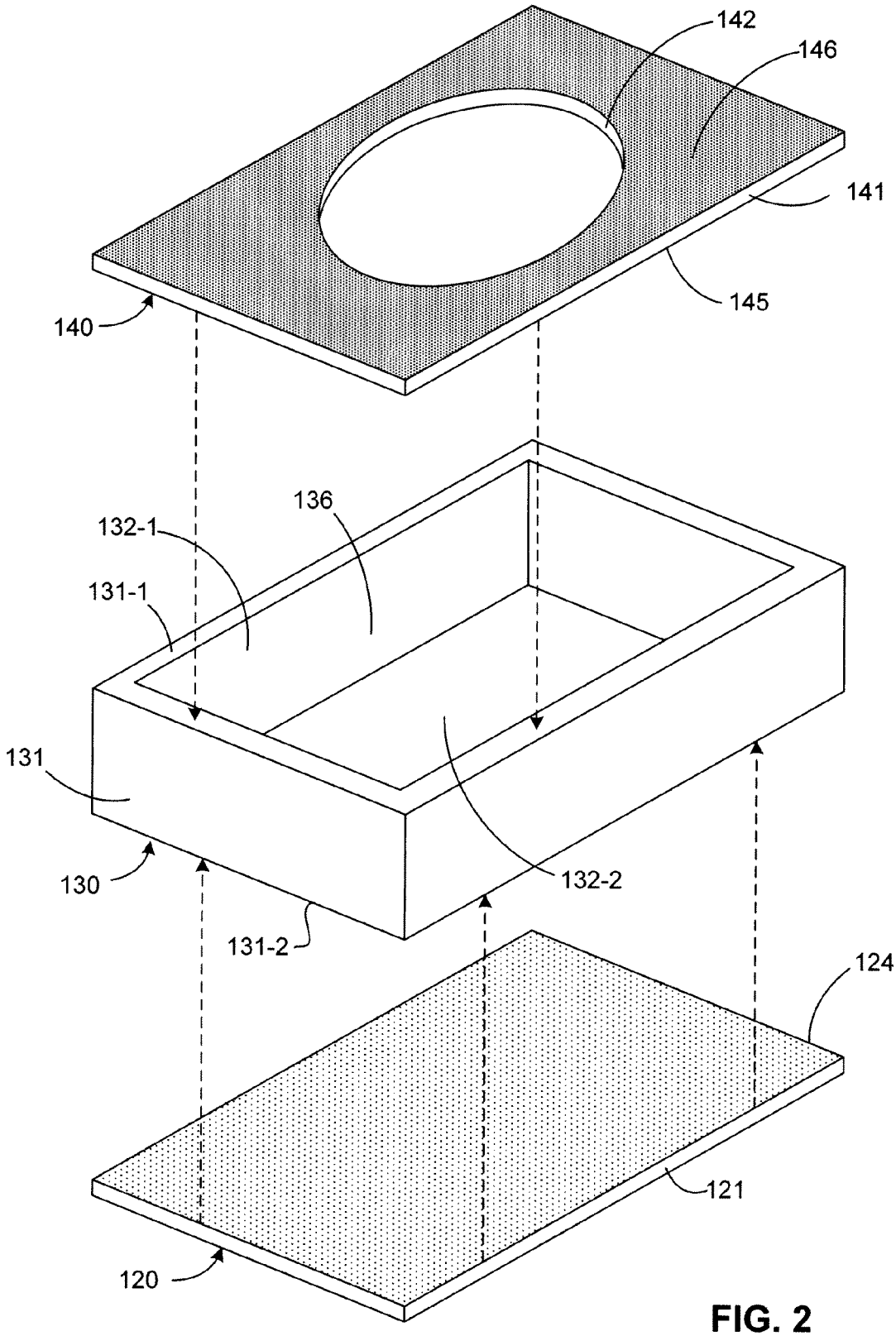
FIG. 2 is a partial exploded perspective view depicting the assembly of the box according to an embodiment of the present invention.

FIG. 2 is a partial exploded perspective view depicting the assembly of the box according to an embodiment of the present invention. The preferred materials for lower box panel 120, box frame 130 and upper box panel 140 is a suitable wood such as redwood, cherry or maple, which wood being selected based on cost and aesthetic appeal considerations. As indicated by the dash-lined arrows in FIG. 2, assembly involves mounting and securing lower panel to lower edge 131-2 of box frame 130 such that upper surface 124 faces into chamber 136 and peripheral edge 121 is substantially aligned with the outer surfaces of peripheral walls 131, whereby lower panel 120 entirely covers (closes) lower frame opening 132-2. Similarly, upper panel 140 is mounted and secured to upper edge 131-1 of box frame 130 such that upper surface 146 faces away from box frame 130, and such that peripheral edge 141 is substantially aligned with the outer surfaces of peripheral walls 131. Note that upper panel 140 only partially covers upper frame opening 132-1 because of box opening 142. In alternative embodiments other materials such as plastic may be used, and one or more of the box components may be combined (e.g., the box may be made using one integral part or two pieces, in contrast to the three part assembly shown in the disclosed embodiment).

Figure 3A:
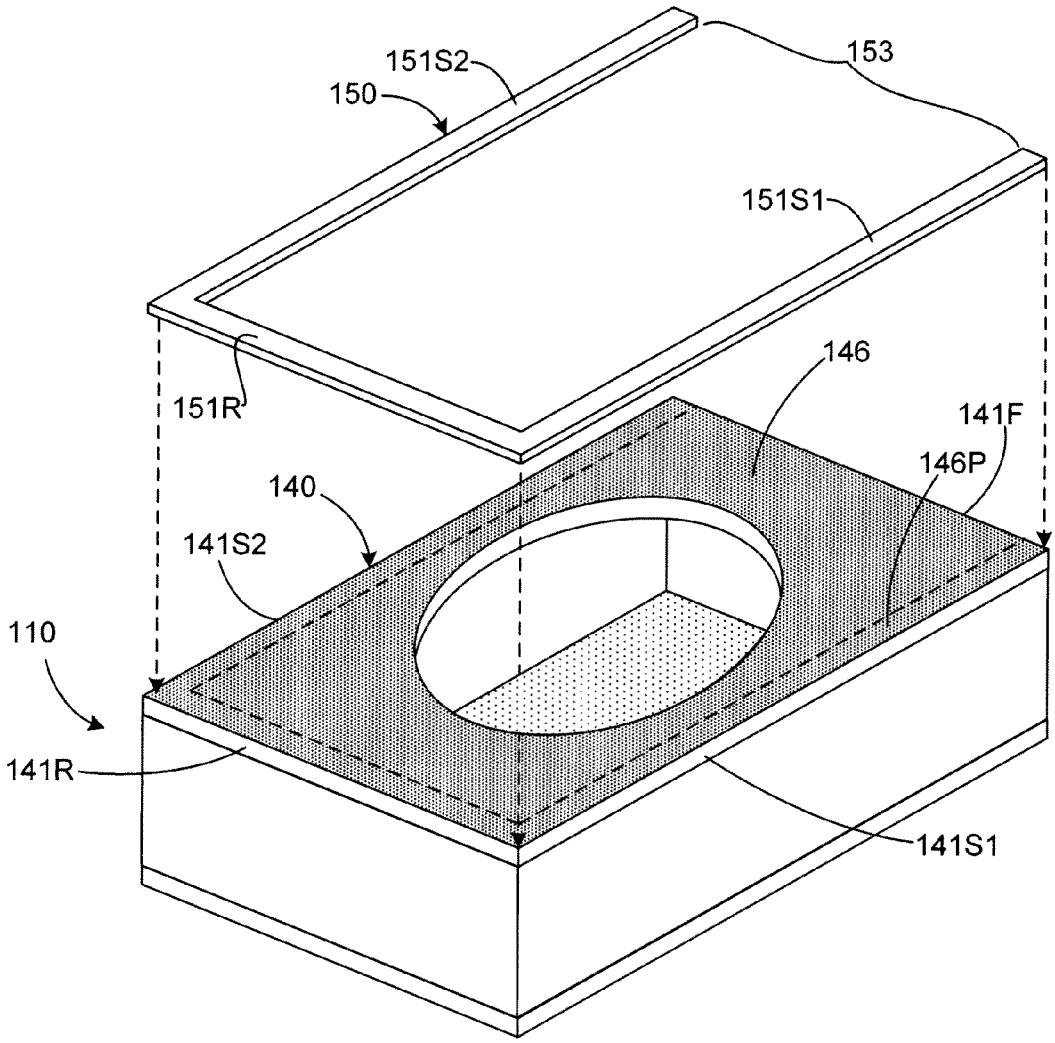
FIGS. 3A and 3B show a generalized assembly process for mounting the picture frame onto the box.
Figure 3B:
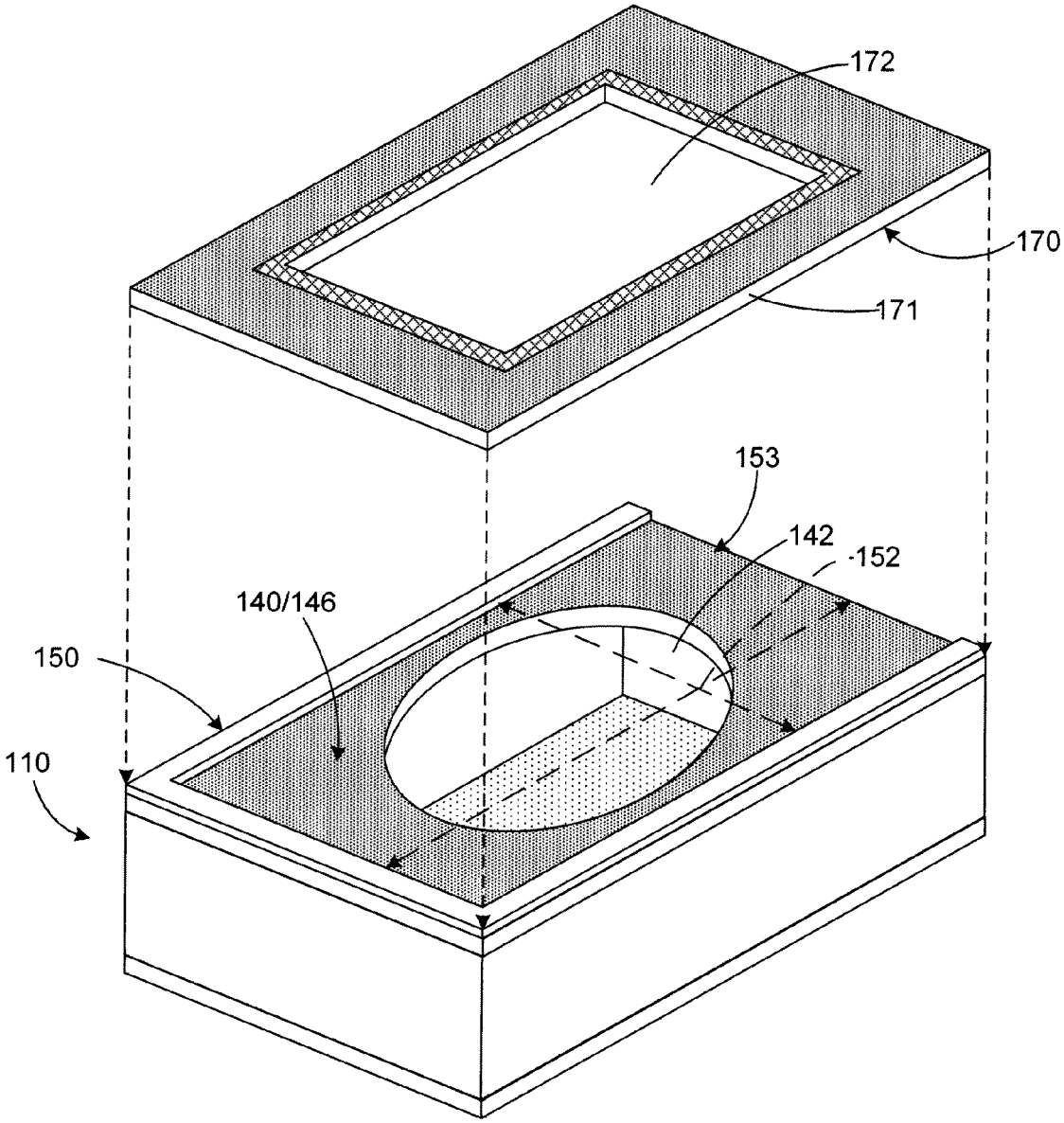

FIGS. 3A and 3B show a generalized assembly process for mounting picture frame 170 onto assembled box 110. FIG. 3A shows a first step involving mounting picture frame support 150 onto peripheral region 146P of upper surface 146 of upper box panel 140. Note that frame support 150 includes three sections 151S1, 151S2 and 151R that are respectively aligned along side edges 141S1 and 141S2 and rear edge 141R of upper panel 140. Note also that no portion of frame support 150 extends along front edge 141F, thereby providing for slot front opening 153. FIG. 3B shows the subsequent step of mounting picture frame panel 170 onto picture frame support 150 such that the outer peripheral edge 171 of picture frame panel 170 is substantially aligned with the side edges of box 110, and such that box opening 142 is exposed through picture frame opening 172. Note that picture frame support 150 maintains picture frame panel 170 at a predetermined offset "slot" distance from upper surface 146 of upper box panel 140, thereby defining a slot 152 that is defined by upper surface 146, inside edges of picture frame support 150, and the lower (downward facing) surface of picture frame 170, and is accessible by way of front opening 153.

Figure 4A:
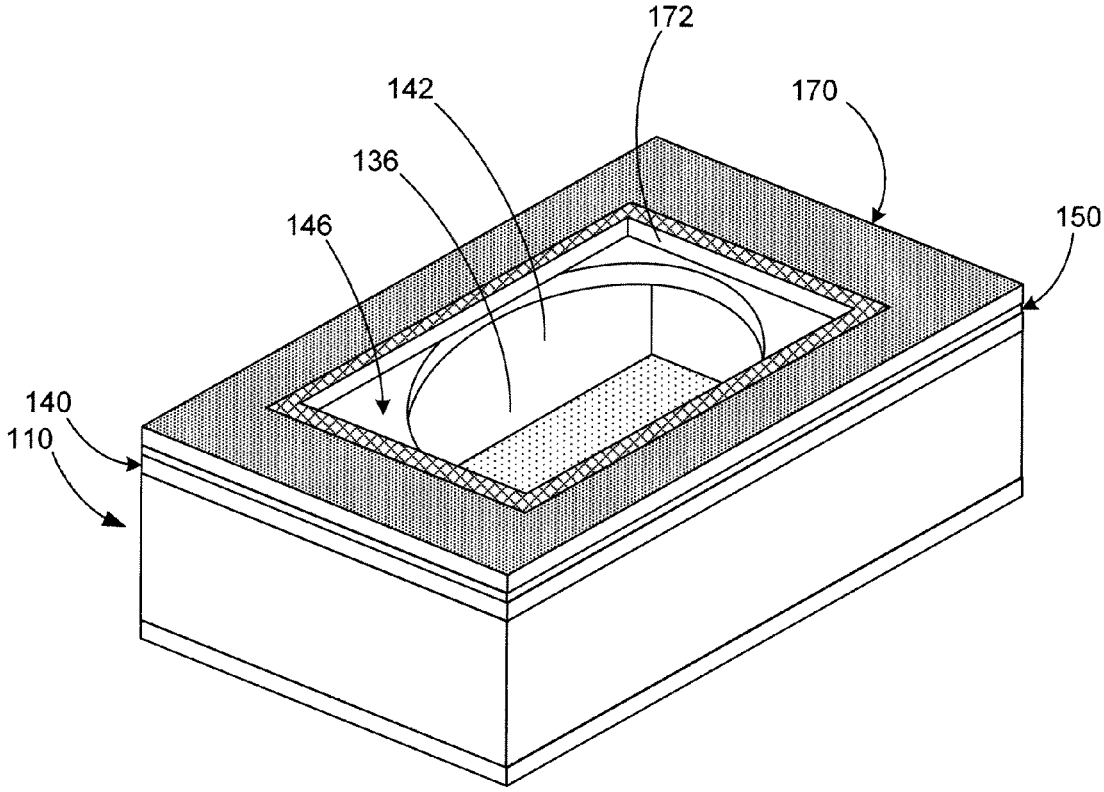
FIGS. 4A and 4B are perspective top and cross-sectional side views of the box and picture frame sub-assembly.
Figure 4B:
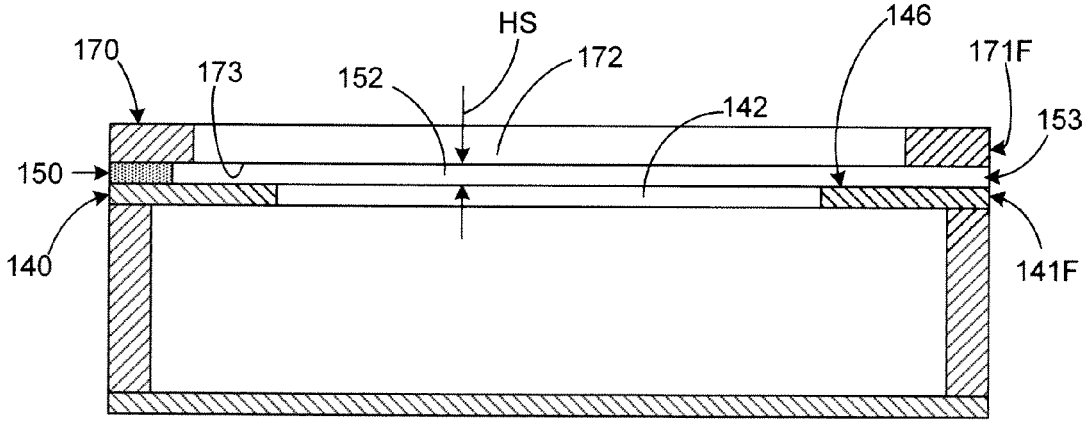

FIGS. 4A and 4B are perspective top and cross-sectional side views of a sub-assembly including box 110 and picture frame panel 170. FIG. 4A shows that picture frame opening 172 is positioned over (aligned with) box opening 142, thereby facilitating the entry of objects into interior 136 of box 110. Note that box opening 142 is smaller than picture frame opening 172 such that a portion of upper surface 146 of upper box panel 140 is visible through picture frame opening 172. FIG. 4B shows that the offset distance (height) HS of picture slot 152 is defined by a thickness of picture frame support 150 and extends between upper surface 146 of upper box panel 140 and a lower surface 173 of picture frame panel 170. FIG. 4B also shows that picture slot 152 has a height HS defined by picture frame support 150, and that slot opening 153 is defined between front peripheral edge 171F of picture frame 170 and front peripheral edge 141F of upper box panel 140.

Figure 5A:
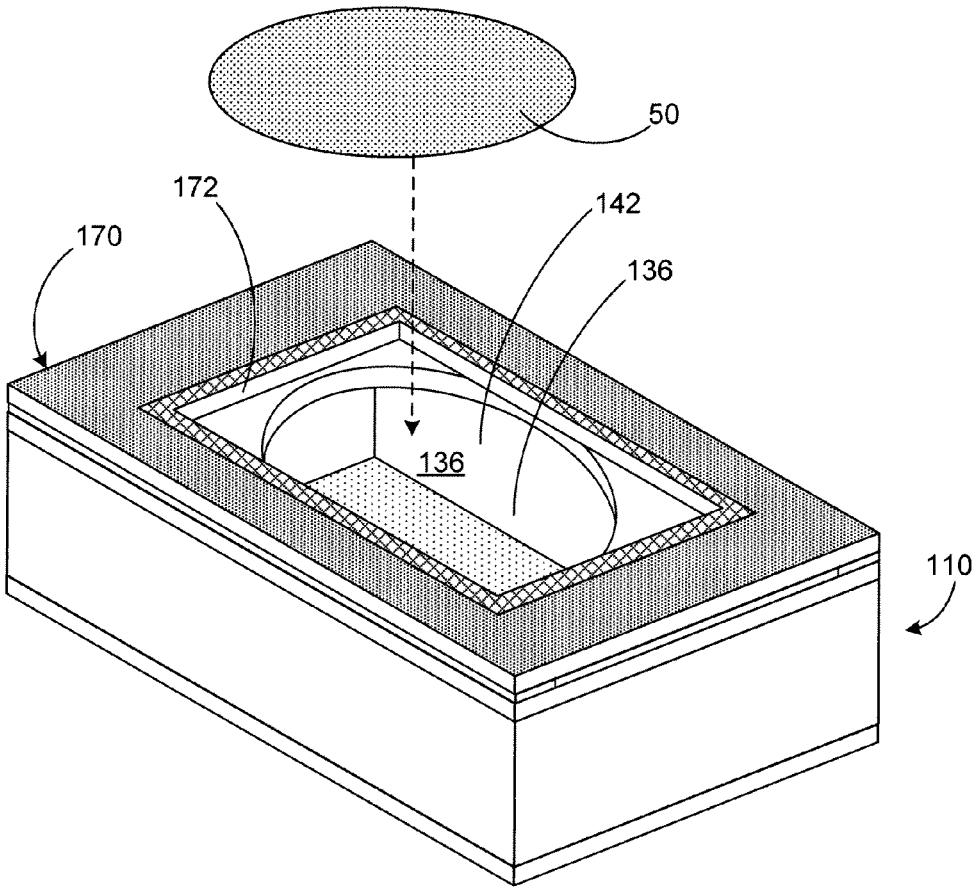
FIGS. 5A and 5B are perspective top and cross-sectional side views illustrating the process of depositing cremated remains inside the box and picture frame sub-assembly.
Figure 5B:
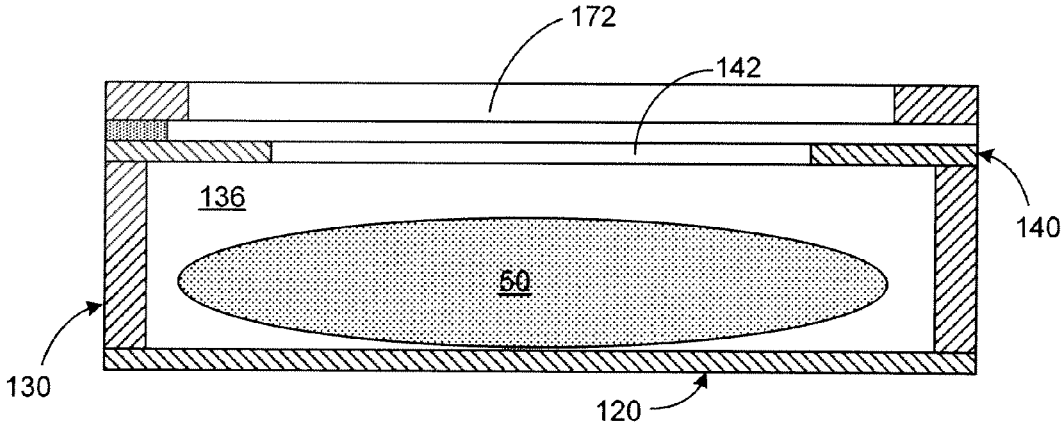

FIGS. 5A and 5B are perspective top and cross-sectional side views illustrating the process of depositing cremated remains 50 into interior (remains chamber) 136 of the sub-assembly formed by box 110 and picture frame panel 170. FIG. 5A shows that cremated remains 50 are inserted through picture frame opening 172 and upper box opening 142 into interior 136 of box 110. FIG. 5B shows remains 50 disposed inside remains chamber 136, which is defined between upper box panel 140, lower box panel 120 and the peripheral walls of box frame 130. At this point remains 50 are visible through upper pane opening 172 and upper box opening 142.

Figure 6:
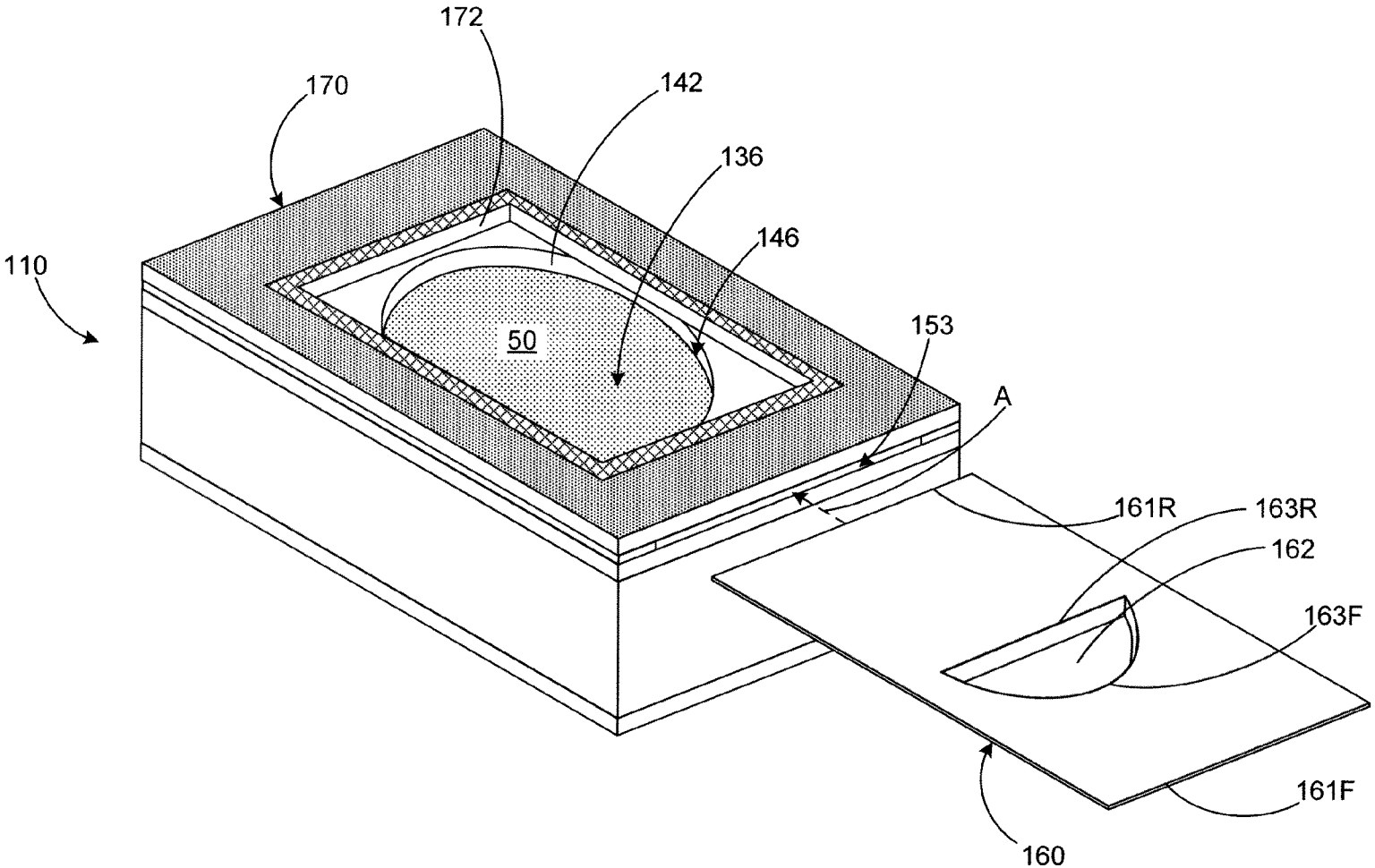
FIG. 6 is a partial exploded perspective view depicting a process of enclosing or sealing the cremated remains inside the box and picture frame sub-assembly.
Figure 7A:
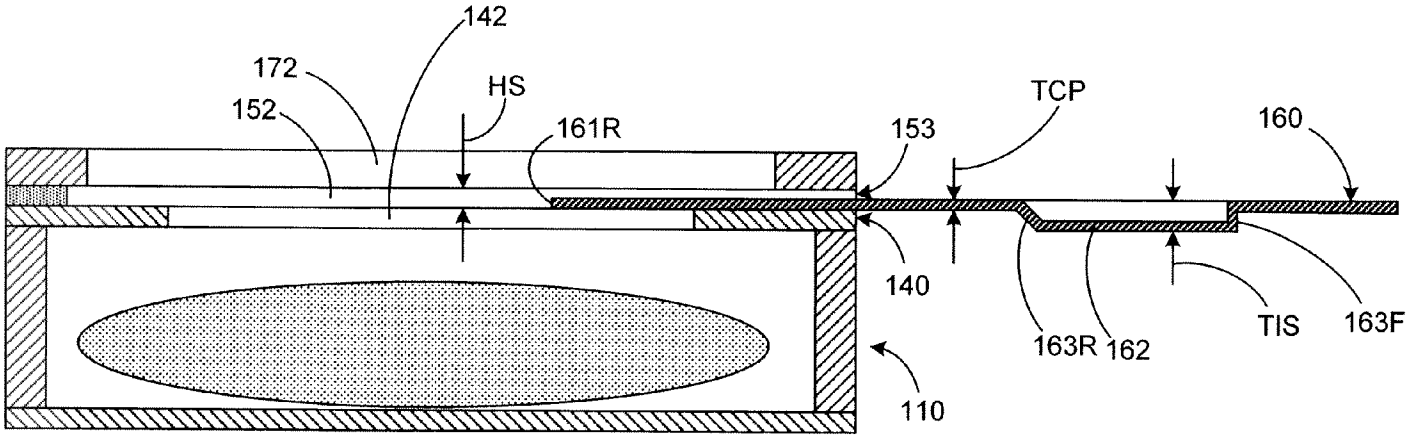
FIGS. 7A and 7B are cross-sectional side views depicting a process of enclosing or sealing the cremated remains inside the box and picture frame sub-assembly.
Figure 7B:
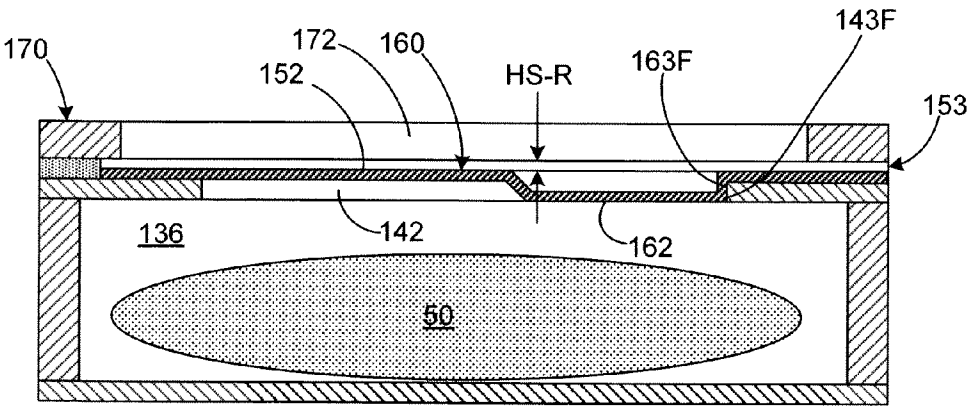

FIGS. 6, 7A and 7B are partial exploded perspective views and cross-sectional side views depicting a process of enclosing or sealing cremated remains 50 inside the sub-assembly formed by box 110 and picture frame 170. As shown in FIG. 6, when remains 50 are initially disposed inside interior 136, remains 50 are visible through upper box opening 142 and picture frame opening 172. Cover panel 160 is mounted to the sub-assembly by inserting a rear edge 161R of cover panel 160 into picture slot front opening 153 and pushing in the direction of the dashed arrow A. As set forth above, the width of cover panel 160 is sized to fit inside the picture slot with minimal clearance. As indicated in FIG. 7A, cover panel 160 is pushed along picture slot 152 until rear edge 163R of indented section 162 reaches picture slot front opening 153. Note that a thickness TIS of indented section 162 (i.e., the distance from the upper planar surface of cover panel 160 to the lowermost point of indented section 162) is sized to either just fit or to require elastic deformation of either indented section 162 or picture frame panel 170 in order to pass through picture slot opening 153. Rear edge 163R is slightly tapered to facilitate the passage of indented section 162 through picture slot opening 153.

Note also that the thickness TCP of the cover panel's main (non-indented) section is smaller than the height HS of picture slot 152 in order to facilitate subsequent insertion and removal of pictures as described below. FIG. 7B shows cover panel 160 when it is fully inserted such that indented section 160 protrudes into box opening 142 (e.g., such that front edge 163F of indented section 162 contacts inside front edge 143F that defines upper box opening 142 in upper box panel 140). In this state, cover panel 160 entirely closes upper box opening 142, thereby blocking a person's view of remains 50 contained in interior 136 of box 110. Note also that, when cover panel 160 is fully inserted, a residual portion HSR of picture slot 152 is defined between the upward facing surface of cover panel 160 and the downward facing surface of picture frame 170—as set forth below, residual portion HSR is sized to facilitate the subsequent insertion of a picture through front slot opening 153.

Figure 8:
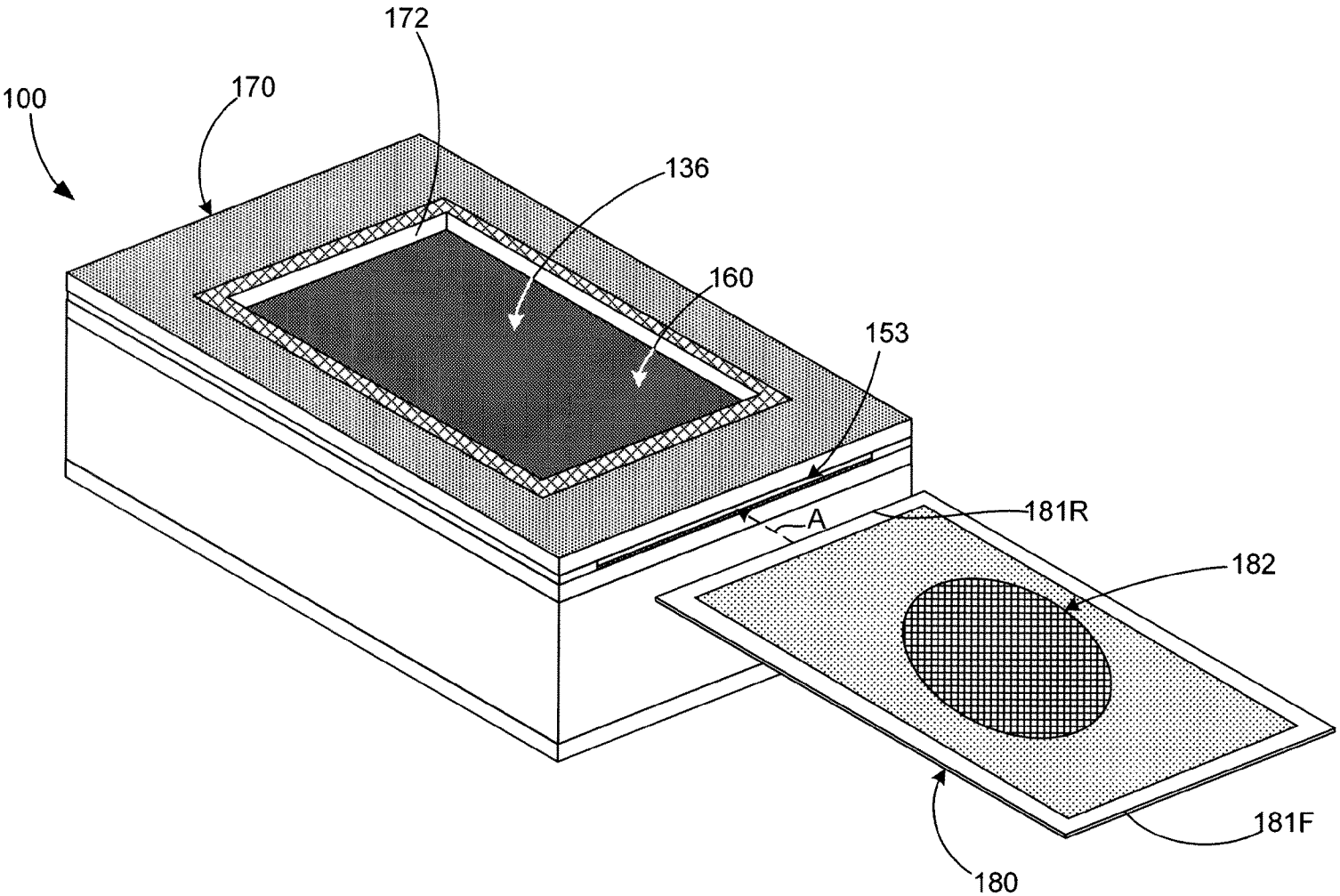
FIG. 8 is a partial exploded perspective view depicting a process of mounting a picture onto the container.
Figure 9A:
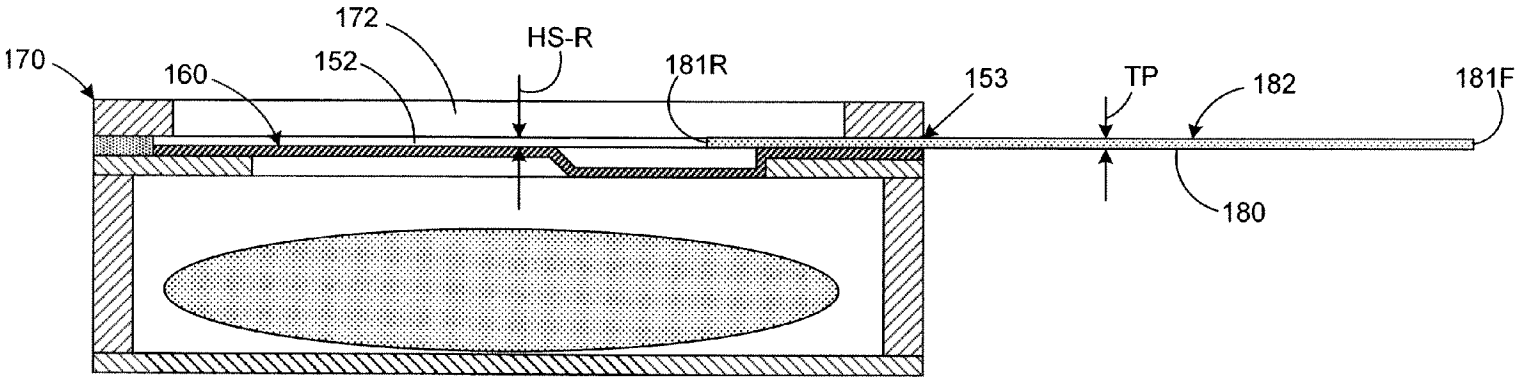
FIGS. 9A and 9B are cross-sectional side views depicting a process of mounting a picture onto the container.
Figure 9B:
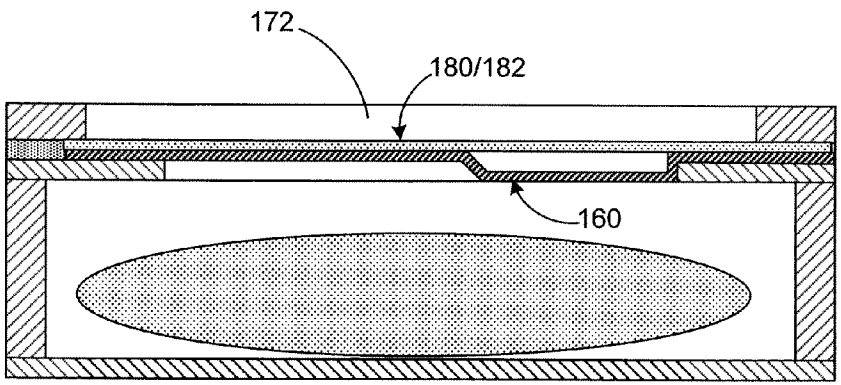

FIGS. 8, 9A and 9B are partial exploded perspective views and cross-sectional side views depicting a process of mounting a picture 180 onto container 100. FIG. 8 shows that picture 180 is mounted by inserting a rear edge 181R of picture 180 with an image 182 facing upward into picture slot front opening 153, and then pushing a front edge 181F of picture 180 in the direction of the dashed arrow A. FIG. 8 further shows that cover panel 160 entirely closes (covers) upper box opening 142, thereby blocking a person's view of remains (or other objects to be concealed) that are disposed in box interior 136. As indicated in FIG. 9A, rear edge 181R of picture 180 is pushed along picture slot 153 between the cover panel and the picture frame until the picture is fully inserted as shown in FIG. 9B. Note that the residual portion HS-R of picture slot 152 (i.e., the portion not taken up by cover panel 160, as indicated in FIG. 9A) is slightly larger than a thickness TP of picture 180, thereby facilitating sliding insertion of picture 180 as shown, but causing picture 180 to be held in place by friction between the upward facing peripheral surface of picture 180 and the downward facing surface of picture frame 170 when picture 180 is fully inserted. As indicated in FIG. 9B, when picture 180 is fully inserted, the only object visible through picture frame opening 172 is image 182 (i.e., cover panel 160 is entirely obscured by picture 180).

Figure 10:
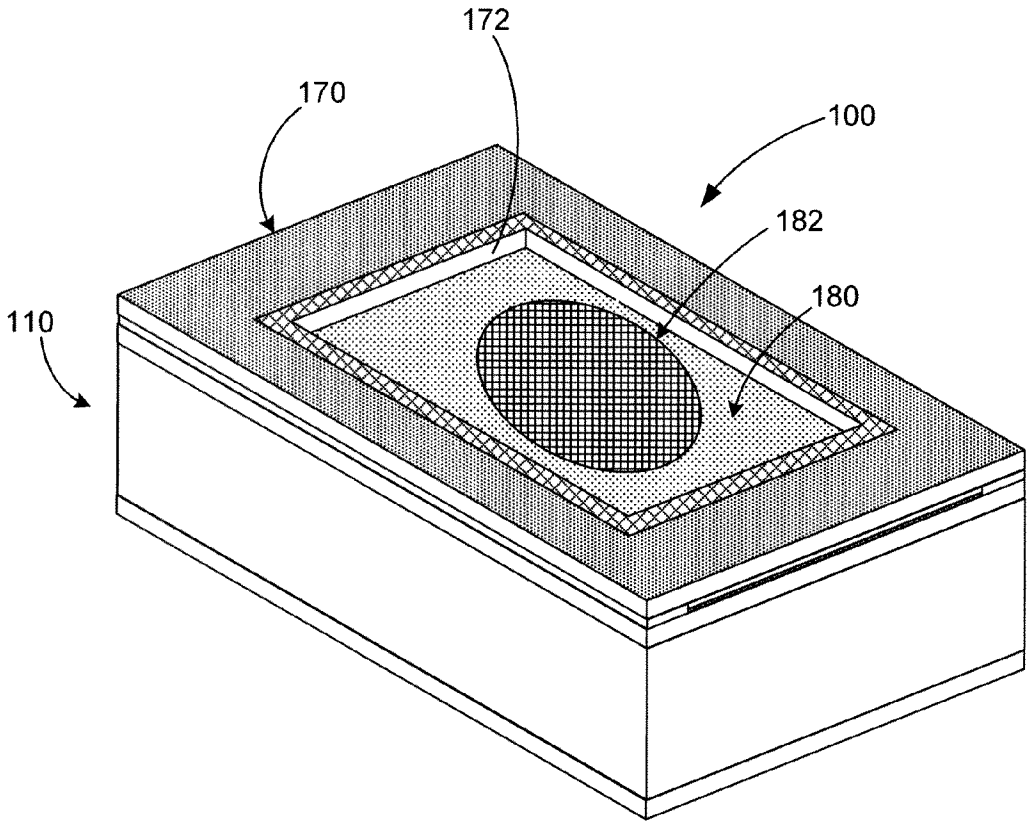
FIG. 10 is a perspective view showing the completed container structure with a picture properly installed.

FIG. 10 is a perspective view showing completed memorial container 100 with a picture 180 properly installed. Note that the picture image 182 is visible through the picture frame opening 172, and that the remaining exposed surfaces of memorial container 100 include the upward facing surface of picture frame 170 and the outer peripheral surfaces of box 110.

Figure 11A:
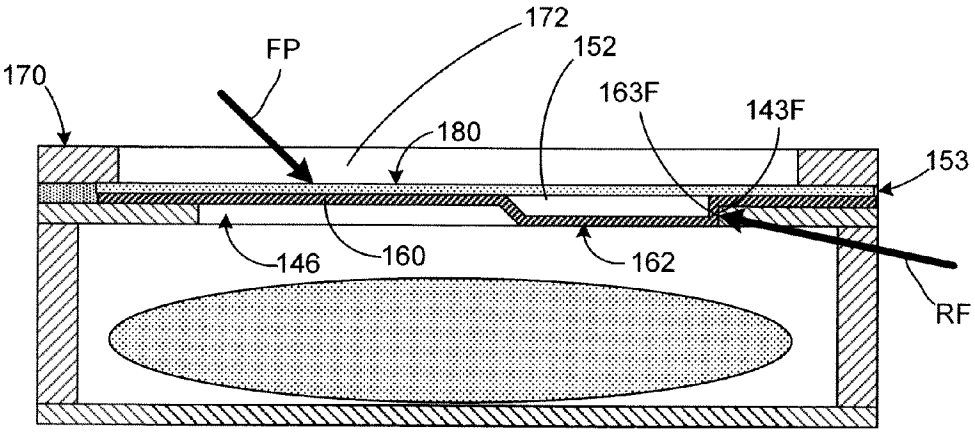
FIGS. 11A and 11B illustrate the process of subsequent removal of the picture to facilitate replacement.
Figure 11B:
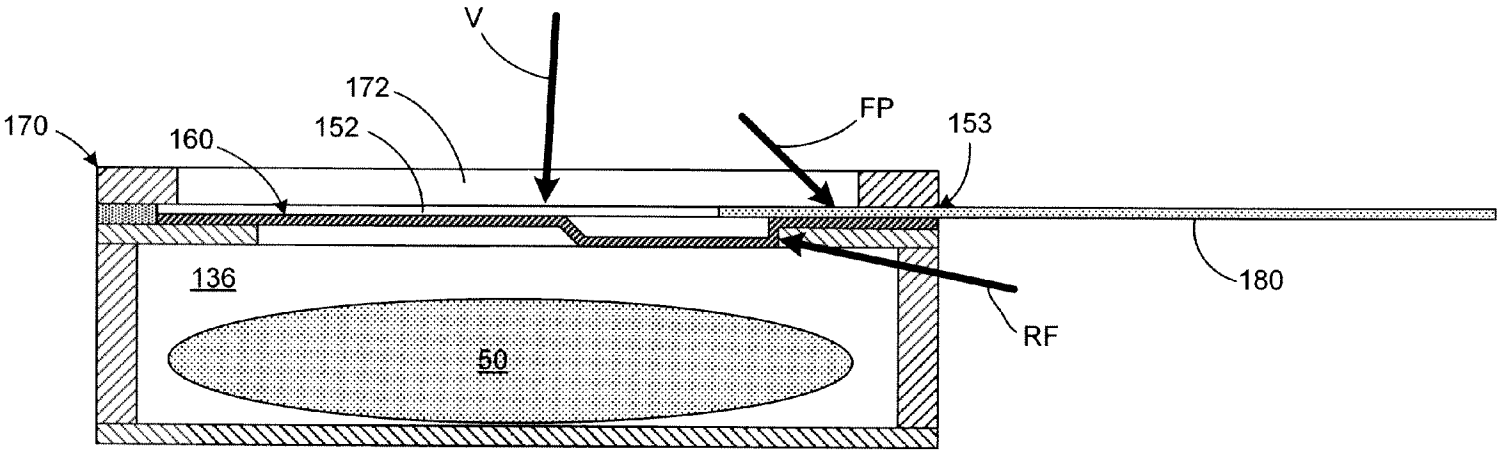

FIGS. 11A and 11B illustrate the process of subsequent removal of picture 180 to facilitate replacement with another picture. In one embodiment, a user's finger presses picture 180 through the picture frame opening 172 of picture frame 170 in a direction that is downward toward cover panel 160 and forward along picture slot 152 toward the picture slot front opening 153 (e.g., in the direction of arrow FP shown in FIG. 11A), thereby causing picture 180 to slide along picture slot 152 toward front slot opening 153. Note that this finger pressure force FP would also cause cover panel 160 to also slide along picture slot 152 except for engagement between front edge 163F of indented section 162 and the inside front edge 143F defining upper box opening 146, whereby this engagement generates a resistive force RF that resists sliding movement of cover panel 160 relative to box 110 (i.e., through front slot opening 153 with picture 180), thereby facilitating the sliding removal of picture 180 without exposure of remains 50 that are disposed in remains chamber 136. As indicated in FIG. 11B, the slide-inducing finger pressure FP is continued until picture 180 is sufficiently pushed through picture slot opening 153 to allow its withdraw (i.e., by manually pulling the remainder of picture 180 through opening 153). Note that, because of resistive force RF, cover panel 160 reliably remains in place during the entire picture removal process without exposure of remains 50 that are disposed in remains chamber 136 (i.e., cover panel 160 prevents viewing remains 50 through picture frame opening 172, as indicated by arrow V in FIG. 11B). Subsequent insertion of a replacement picture is then performed using the process described above.

The above description is intended to illustrate a preferred embodiment in which the box is rectangular and sized to receive standard-sized photographs (e.g., 4×6, 5×7 or any other standard photograph size). A benefit of the rectangular arrangement is that the box may be set on either its side to display landscape oriented photographs, or on its end to display portrait-oriented photographs. Although this arrangement is preferred, it is not considered limiting, and in alternative embodiments the peripheral wall of the box/container may be formed with an oval, round, or other non-rectangular shape.

Although the present invention has been described with respect to certain specific embodiments, it will be clear to those skilled in the art that the inventive features of the present invention are applicable to other embodiments as well, all of which are intended to fall within the scope of the present invention. For example, in alternative embodiments a transparent cover sheet (e.g., glass or plastic) is mounted on the picture frame over the picture frame opening, or inserted into the picture slot between the picture frame and an inserted picture, and serves to preserve and protect the picture from dust or damage passing through the picture. In addition, although the present invention has been described with reference to a cremated remains memorial container, the structure described herein may be utilized as a container for other purposes.

The invention claimed is:

1. A cremated remains memorial container with picture frame comprising:

a box having an upper panel defining an upper box opening through which cremated remains can be inserted into an interior of the box;

a picture frame panel securely attached to the box such that a picture slot defined between the picture frame panel and the upper panel has a substantially uniform predetermined height, the picture frame panel defining a picture frame opening disposed such that cremated remains can be inserted through the picture frame opening and the upper box opening into the interior of the box; and a cover panel slidably inserted into the picture slot and having an indented portion partially extending through the upper box opening into the interior of the box, wherein the indented portion is formed such that when a picture is inserted or removed from a residual portion of the picture slot disposed between the picture frame panel and the cover panel, engagement between the indented portion and an inside edge of the upper box opening prevents slidable removal of the cover panel with the picture, thereby preventing undesirable exposure of the cremated remains contained in the interior of the box.

2. The cremated remains memorial container with picture frame of claim 1, wherein the box comprises one of wood or plastic.

3. The cremated remains memorial container with picture frame of claim 1, wherein the box comprises a lower panel, a box frame, and said upper panel, wherein said lower and upper panels are respectively fixedly secured to lower and upper edges of the box frame.

4. The cremated remains memorial container with picture frame of claim 3, wherein the lower and upper panels are respectively fixedly secured to lower and upper edges of the box frame by an adhesive.

5. The cremated remains memorial container with picture frame of claim 1, further comprising a picture frame support secured to an upper surface of the upper panel along opposing side and rear peripheral edges of the box, wherein the picture frame panel is fixedly secured to the picture frame support, and wherein the picture slot includes a front slot opening defined between a front peripheral edge of the picture frame support and a front peripheral edge of the upper box panel.

6. The cremated remains memorial container with picture frame of claim 5, wherein the picture frame support comprises double-sided tape.

7. The cremated remains memorial container with picture frame of claim 5, wherein the front slot opening is wider than the cover panel such that the cover panel is insertable through the front slot opening into the picture slot.

8. The cremated remains memorial container with picture frame of claim 1, wherein the cover panel comprises an opaque plastic.

9. A cremated remains memorial container with picture frame comprising:

a box having an upper panel defining an upper box opening that communicates with an interior of the box for insertion of cremated remains therein;

a picture frame panel securely attached to the box such that a picture slot is defined between the picture frame panel and the upper panel, the picture frame panel defining a picture frame opening disposed over the upper box opening; and a cover panel slidably inserted into the picture slot and having an indented portion partially extending through the upper box opening into the interior of the box, wherein the indented portion is formed such that when a picture is inserted or removed from a residual portion of the picture slot disposed between the picture frame panel and the cover panel, engagement between the indented portion and an inside edge of the upper box opening prevents slidable removal of the cover panel with the picture.

10. A container with picture frame comprising:

a box having an upper panel defining an upper box opening that communicates with an interior of the box;

a picture frame panel securely attached to the box such that a picture slot defined between the picture frame panel and the upper panel has a substantially uniform predetermined height, the picture frame panel defining a picture frame opening disposed such that an object can be inserted through the picture frame opening and the upper box opening into the interior of the box; and a cover panel slidably inserted into the picture slot and having an indented portion partially extending through the upper box opening into the interior of the box, wherein the indented portion is formed such that when a picture is inserted or removed from a residual portion of the picture slot disposed between the picture frame panel and the cover panel, engagement between the indented portion and an inside edge of the upper box opening prevents slidable removal of the cover panel with the picture.

* * * * *